US006591639B2

(12) United States Patent
Voth

(10) Patent No.: US 6,591,639 B2
(45) Date of Patent: Jul. 15, 2003

(54) METHOD OF AND AN ARRANGEMENT FOR CONTINUOUS THERMAL TREATMENT OF A TEXTILE PRODUCT WEB, IN PARTICULAR FOR DYE FIXING

(75) Inventor: Marc-Aurel Voth, Hamburg (DE)

(73) Assignee: Babcock-Textilmaschinen GmbH, Seevetal (DE)

( * ) Notice: Subject to any disclaimer, the term of this patent is extended or adjusted under 35 U.S.C. 154(b) by 0 days.

(21) Appl. No.: 10/144,367

(22) Filed: May 13, 2002

(65) Prior Publication Data

US 2002/0124327 A1 Sep. 12, 2002

Related U.S. Application Data

(62) Division of application No. 09/580,263, filed on May 26, 2000, now Pat. No. 6,485,526.

(30) Foreign Application Priority Data

May 28, 1999 (DE) ..... 199 24 433

(51) Int. Cl.[7] ..... D06B 3/10; D06B 21/00
(52) U.S. Cl. ..... 68/5 E
(58) Field of Search ..... 68/5 D, 5 E; 34/619, 34/634, 636, 643

(56) References Cited

U.S. PATENT DOCUMENTS 2,590,850 A * 4/1952 Dungler ..... 68/5 D
2,833,136 A * 5/1958 Prince et al. ..... 68/5 D
3,124,429 A * 3/1964 Alexeff et al. ..... 68/5 D
4,070,877 A * 1/1978 Fleissner ..... 68/5 D

FOREIGN PATENT DOCUMENTS

FR 2478150 * 9/1981 ..... 68/5 E
GB 718415 * 11/1954 ..... 68/5 E
SU 342687 * 7/1972 ..... 68/5 E

* cited by examiner

*Primary Examiner*—Philip Coe
(74) *Attorney, Agent, or Firm*—Michael J. Striker

(57) ABSTRACT

The apparatus for dyeing including simultaneous dye fixing and drying of a textile product web has a device for applying dye solution to a product web; a steam-tight housing having one or more steam treatment chambers for heat treating the moist product web; a transporting device for conveying the moist product web horizontally through the steam treatment chamber or chambers: at least one circulating device for circulating hot steam in the treatment chamber or chambers and nozzle boxes arranged in the steam-tight housing above and below the horizontally conveyed product web for blowing superheated steam at the horizontally conveyed product web. In arrangements with two treatment chambers the transport device includes a roller conveyor arranged in the region between the treatment chambers and has two guiding rollers and a pulling roller. A method of heat treatment of the textile product using the arrangement is also described.

6 Claims, 2 Drawing Sheets

METHOD OF AND AN ARRANGEMENT FOR CONTINUOUS THERMAL TREATMENT OF A TEXTILE PRODUCT WEB, IN PARTICULAR FOR DYE FIXING

CROSS-REFERENCE TO RELATED APPLICATIONS

The present application is a divisional of Ser. No. 09/580,263, which was filed on May 26, 2000, and now U.S. Pat. No. 6,485,526, and contains subject matter in common with copending U.S. patent application Ser. No. 09/580,261, also filed on May 26, 2000, and now U.S. Pat. No. 6,471,724.

BACKGROUND OF THE INVENTION

The present invention relates to a method for continuous thermal treatment of a textile product web, in particular for dye fixing, as well as to an arrangement for performing the inventive method.

During coloring it is necessary to fix a dye applied on the textile product web. The dye fixing can be performed by retaining the product web with applied dye solution at room temperature or the moist or dried product web at higher temperatures. The fixing treatment depends on the material of the product web and the applied dye.

During coloring of chemical fibers with dispersion dyes, for example it is known to first dry the product web with applied dying solution and subsequently to fix the dye at higher temperatures on the product web.

German patent document DE/A 16 35 140 discloses a method of continuous dye fixing of chemical fibers in product webs by a high temperature treatment with convective heat transfer, for example from nozzle-aerated fixing tension frames. For blending of the fixing effect first a fast heating and subsequently a tension treatment is performed. During the fast heating the product web is guided in tensioning chains and during the retention treatment over normal guiding rollers.

During coloring of cotton or cellulose with reactive dyes it is for example known to first dry the product web with the dye solution applied to it and subsequently to let the dye react at higher temperatures with the fibers of the product web. For this first purpose a promoter, such as urea, is required, which is mixed to the dye solution. The promoter holds the dye in solution during drying and evaporates during fixing. As a treatment gas, heated air is used. The use of an aggressive promoter, such as urea, can be reduced or avoided by treatment of the product web with applied dye solution with a steam-air mixture.

From the patent document EP/A 0 864 683 it is known to impregnate a product web of cellulose knit or woven fabric with an aqueous dye solution of a fiber-reactive dye at a temperature of 20–25° C. to compress it, and to fix it without intermediate drying in an unsaturated water steam-air mixture, with 10–80 vol. percent of water steam, at a temperature of 100–160° C. and with an adjustable wet temperature of the moist product between 50 and 95° C. The product is guided with a speed, which is regulated by the measured residual moisture of the product after exit from the fixing device. The residual moisture amounts to 10–25 weight percent with respect to the product weight.

The patent document WO 97/14839 discloses a corresponding method and a device for dye fixing of cellulose products with reactive dyes, in which an optimal dye yield is obtainable without aggressive promoter quantities. In a padder the dying solution is applied on the product, and is subsequently guided in a chamber of an air dryer. In this chamber a steam contact is maintained in the order of 25 vol. percent of air and is supplied so that the product of the outlet of the chamber has a reaction-ready residual moisture. For this purpose two regulating circuits are used, namely one for the steam content and another for the residual moisture of the product web. In other words during this process expensive measuring and regulating devices are needed. This fixing method requires, due to the retention time of the order of two minutes in a continuous process with a product web speed of for example 40 m/min, a product extent in the retention aggregate, here a hot flue, of at least 80 m. It is therefore not efficiently usable for small quantities to be colored (small meter lengths).

SUMMARY OF THE INVENTION

Accordingly, it is an object of present invention to provide a method of continuous thermal treatment, in particular for dye fixing, in which the treatment gas contains hot steam and which can be used efficiently for smaller meter length.

In keeping with these objects and with others which will become apparent hereinafter, one feature of the present invention resides, briefly stated, in a method of continuous thermal treatment of a textile product web for dye fixing, comprising the steps of applying a dye solution to a product web; transporting the resulting moist product web with the dye solution applied to it through at least one treatment chamber; bringing the moist product web with the applied dye solution in contact with a treatment gas in the treatment chamber. The treatment gas contains hot steam, i.e. overheated water steam.

It is another object of present invention to provide an arrangement with which the new method of thermal treatment can be performed efficiently and faster.

In keeping with these objects, another feature of the present invention resides, briefly stated, in an arrangement for continuous thermal treatment of a textile product web for dye fixing, comprising a steam-tight housing with at least one treatment chamber having at least one circulating device with at least one circulating fan, nozzle boxes arranged above and below the product web; a transporting device for substantially flat guidance of the product web through the housing, the transporting device including at least one roller conveyor arranged at a distance from a front wall of the housing.

In the inventive method for continuous thermal treatment of a textile product web, the moist product web provided with dye solution is transported through at least one treatment chamber and is brought into contact in the treatment chamber with a treatment gas, which is composed of hot steam. The treatment gas is at least 80 vol. percent, preferably 95–120 vol. percent, or, in other words, approximately pure hot steam. The temperature of the hot steam amounts to 105–230° C. The hot steam used in the method according to the invention is overheated water steam substantially at atmospheric pressure.

With a higher steam content, higher temperatures of the product web are reachable during the thermal treatment. In particular with pure hot steam the product web temperature is increased to substantially 100° C. The higher treatment temperature accelerates the reaction of the dye with the fibers during fixing of reactive dye on cotton or cellulose. This leads to lower fixing times, correspondingly lower retention times in a treatment device, and possibly smaller devices.

A higher steam content of the treatment gas accelerates, due to the condensation ability of the hot steam, the heating, which leads to a further reduction of the required retention time. In a surprising manner the inventive treatment method, despite the higher steam content and the higher product temperature, and thereby increased drying, leads to good fixing results. In other words, it leads to a good dye yield and a good coloring quality, which correspond to the results of the prior art.

The drying of the moist product web during the treatment with hot steam provides lower fixing times for complete fixing. This is achieved by an acceleration of the fixing process, i.e. the reaction of the reactive dye with natural fibers, such as cotton and cellulose, by the drying.

The input moisture of the product web provided with the dye solution of the reactive dye amounts to 40–80%. For many reactive dyes the use of urea can be dispensed with.

The temperature of the hot steam can be preferably 160–230° C. The higher temperature of the treatment gas and thereby the higher the temperature difference between the treatment gas and the product, the greater the heat transfer and thereby faster the heating time of the product web and the drying of the product web.

The retention time of the product web in the arrangement is 50–60 seconds, preferably 10–30 seconds. This time is sufficient for complete fixing for good dye yield and makes possible to have an arrangement with a smaller structural dimension.

In a surprising manner it has been determined that with the inventive method optimal fixing results are provided with a residual moisture of the product web smaller or equal to the equilibrium moisture under normal conditions, or in other words approximately 10% moisture to the weight of the product for cellulose and approximately 8% moisture for cotton. This can be explained by the above mentioned accelerated action of the drying for the dye fixing. Regulation of the residual moisture of the product web in the arrangement is not needed.

In principle all processes, with which the product web can be brought in contact with hot steam, can be used for the inventive method.

For this method, a guidance of the product web through the chamber filled with hot steam can be performed in form of suspending loop or a meandering guidance of the product web in two rows of guiding or transporting rollers, as far as it is suitable for transportation of a moist, colored and unfixed product web.

For improving the heat transfer from hot steam to the product web and thereby reducing the retention time, the product web in accordance with the present invention can be brought into contact with hot steam which is guided in a circulating process, through nozzles which are oriented toward the product web. This is possible in the inventive method without dye running, since because of the high steam content and in some cases the high steam temperature, a fast drying of the product web and thereby of the dye is provided.

Devices with a meandering guidance of the product web around two rows of rollers or on nozzles oriented toward the product web are known as hot flu. The above mentioned devices have however as disclosed in the patent document WO 97/148 39 a very high product extent and are, for example due to untightness, not suitable for an operation with hot steam.

A further improvement of the heat transfer can be obtained when the product web is transported substantially flat through the treatment chamber and is brought in contact with hot steam from nozzle boxes arranged above and below the product web.

Devices, by which the product web is transported flat and brought in contact with a treatment gas by nozzle boxes, namely nozzle-equipped fixed tension frames, are known for fast heating during dye fixing of chemical fibers, such as thermal insulation, for example from the German patent document DE/A 16 35 140.

Devices of this type, in which hot steam can be suitably used as treatment gas are disclosed in the German patent document DE 35 11 95. In particular a suspension dryer and a tension frame dryer.

During a suspended guidance of the product web in a suspension dryer the danger of producing wavy portions of the product web which can lead during fixing to dye running is high. Tension chains during dye fixing have the disadvantage that the edge markings are caused.

A further, corresponding device, namely a tension frame dryer usable for hot steam treatment is disclosed in the German patent document DE 195 46 344. The inlet slot and the outlet slot of this dryer are arranged in a bottom of its housing. The product web is guided through the dryer from the inlet region to the outlet region flatly and therefore horizontally.

Preferably the product web in the inventive method is transported by means of a roller conveyor arranged at a distance to a front wall of the housing with a longitudinal tension, in particular of 10–100 N/M through the treatment chambers. The distance from the front wall amounts to at least 20% preferably 30% of the length of the horizontal transporting path of the product web through the treatment chambers. The product web first is guided by the roller conveyor when it and thereby the dye is dried. During the drying and during the total fixing process the product web in view of the longitudinal tension is guaranteed to have a uniform fixing and thereby a uniform dye yield. A guidance of the product web by a roller conveyor moreover is a simple transporting method, when for example compared with a tension chain guidance, and makes possible simpler inlet and outlet in the treatment chamber.

An arrangement for continuous thermal treatment of a textile product web, in particular for dye treatment, comprises a steam-tight housing with at least one treatment chamber having a circulating device, i.e. a device for providing hot steam in a circulation process, at least one circulating fan, nozzle boxes arranged above and below the product web in each treatment chamber, a transporting device for a substantially flat or horizontal guidance of the product web through the housing, and at least one roller conveyor, as an essential part of the transporting device, arranged at a distance to the front wall of the housing. The distance to the front wall amounts to at least 20%, preferably 30%, of the length of the horizontal transporting path of the product web through the treatment chamber or chambers.

A rolling conveyor can have two rollers which are offset relative to one another. They are adjustable relative to one another by producing a longitudinal tension. A roller conveyor can have two rods or rollers which guide the product web in its transportation plane, and a pulling roller arranged between both rods or rollers above and below of the transporting plane and adjustable perpendicular to the transporting plane. In this case the product web is guided in form of the loop around the pulling roller and held by deviation of the pulling roller perpendicular to the transporting plane and the longitudinal tension. This device is especially suitable for the inventive method.

In the inventive device having at least two treatment chambers arranged one after the other, the roller conveyor is arranged in the region in which both treatment chambers abut against one another. In other words the distance of the roller conveyor to the front wall amounts to substantially 50% of the length of the horizontal transporting path of the product web through the treatment chambers. The treatment chambers are also called fields and the regions between the treatment chamber are also called field abutments.

The roller conveyor can have two guiding rollers and one vertically adjustable pulling roller. The guiding rollers are arranged closely one after the other and the pulling roller is arranged in the center under the guiding rollers. This arrangement of the guiding rollers and pulling rollers makes possible a small abutment region of the treatment chambers, or in other words the region of the regions in which no nozzle boxes are arranged.

The pulling roller can be formed simultaneously as an orienting roller. Therefore, additional means for orienting of the product web are dispensed with.

In accordance with a further feature of the present invention, the arrangement has locks before and after the housing. The locks extend from the bottom to above the transporting plane of the product web and have deviating rollers near the bottom end at the height of the transporting plane. The locks are subdivided into a lower, downwardly open pre-chamber and a further main chamber arranged over it. Suction passages or suction boxes can be connected with the pre-chambers. When compared with the known inlet and outlet slots with suction boxes disclosed in the German patent document DE-A 195 46 344, due to the separate locks with the pre-chamber and suction devices, the penetration of air and thereby condensation of steam to water is reliably prevented. A lock disclosed in the German patent document DE 198 58 839, in which steam is blown on the product web before the inlet slot of the housing, is less suitable for fixing of dye because of the danger of dye running.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
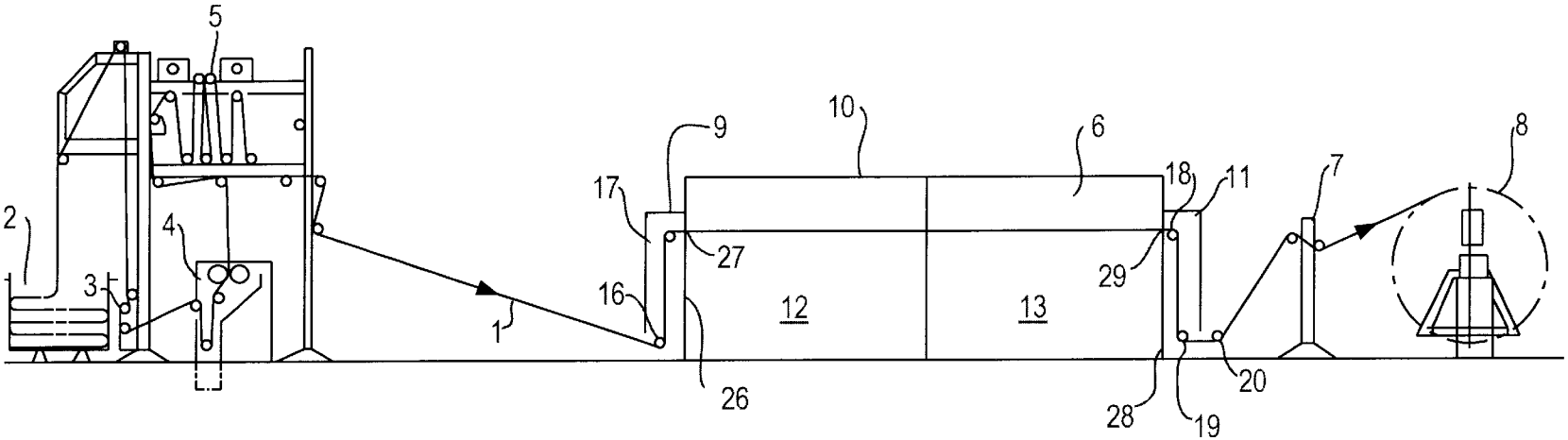
FIG. 1 is a schematic side cross-sectional view showing a device for continuously dyeing a product web with a dye solution, which has an inventive arrangement for dye fixing.

A device for dyeing a textile product web 1, for example of cotton or cellulose, with a reactive dye has several units arranged in a transporting direction one behind the other and including a product storage 2, a supply device 3, a dye device 4, an air passage 5, a device for dye fixing 6, a further supply device 7 and a further product storage device 8. In this example the front product storage 2 is formed as a container, the dye device 4 is formed as a padder, the rear product storage 8 is formed as a winding roller and the supply devices 3, 7 are formed as booms. The device for dye fixing 6 has an inlet lock 9, a steam-tight heat insulated housing 10 and an outlet lock 11. The housing 10 includes at least one, preferably two to five, and in the embodiment shown here, two modular treatment chambers 12, 13 arranged one after the other in a row. The interior of the housing 10 is subdivided by the treatment chambers 12, 13, into two fields arranged one after the other. The housing 10 is not subdivided and surrounds all treatment chambers 12, 13.

Figure 2:
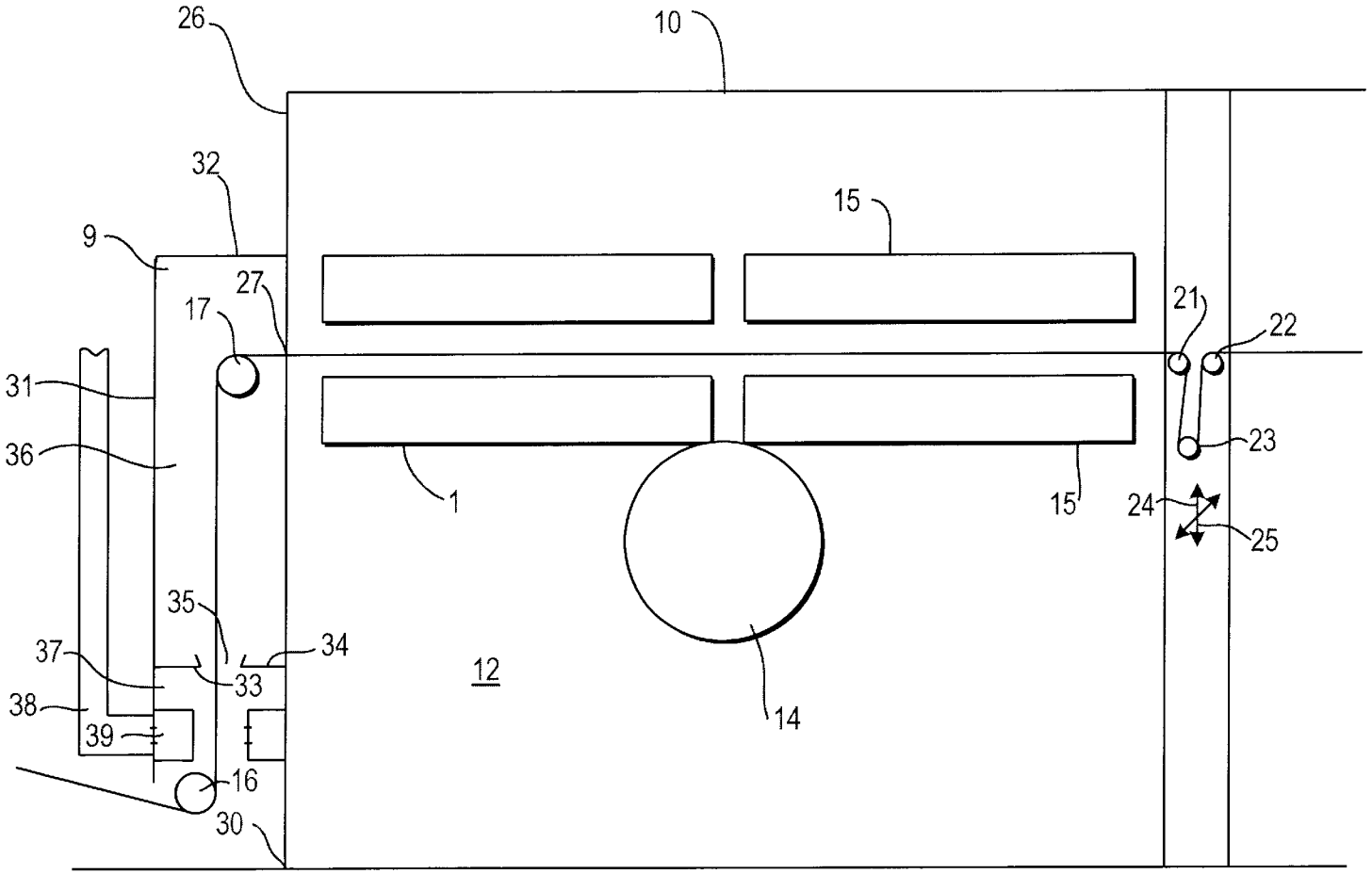
FIG. 2 is a view showing an input lock, a first treatment chamber and the roller conveyor of the inventive arrangement.

A circulating device, or in other words a device for guiding wet steam in a circulation which is identified as a circulating process is provided in each treatment chambers 12, 13. It has a circulating fan 14. Each treatment chamber also has a heating device which is not shown in FIG. 2 and nozzle boxes 15 with nozzle openings directed toward the product web 1. In one treatment chamber 12, 13, several, for example two nozzle boxes 15 can be arranged above and below the product web 1 transversely over the product web. The nozzle openings are preferably formed as slots.

A transporting device has guiding rollers 16, 17 in the inlet lock 9 and guiding rollers 18, 19, 20 in and downstream of the outlet lock 11. In addition, the transporting device has a roller conveyor with two guiding rollers 21, 22 and a pulling roller 23 in the region in which the both treatment chambers 12, 13 abut against one another. The roller conveyor thus extends over the half of the transporting path of the product web 1 from the inlet slot 27 in the front wall 26 to the outlet slot 29 in the rear wall 28. The both guiding rollers 21, 22 have identical sizes and are arranged close to each other at the same height. The arrangement of the guiding rollers 21, 22, the last guiding roller 17 of the inlet lock, and the first guiding roller of the outlet lock 11 is such that the transporting plane of the product web 1 in the treatment chambers 12, 13 is flat and horizontal.

The pulling roller 23 is arranged in the center, under the guiding rollers 21, 22 so that it is vertically adjustable. It is formed simultaneously as an orienting roller, in other words it is adjustable in a plane extending through its axis parallel to the transporting plane. The height adjustment of the pulling roller 23 is identified by the arrow 24 and the orienting ability by the arrow 25. The pulling roller 23 is moreover connected with a not shown drive. The housing 10 has an inlet slot 27 on the front wall of the first treatment chamber 12 and an outlet slot 29 on the rear wall 28 of the last treatment chamber 13, through which the product web 1 is introduced into the housing 10 and withdrawn from it.

The inlet lock 9 has a front plate 31 which extends parallel to the front wall 26 in the vicinity of a lower edge 30 to above the inlet slot 27, a cover plate 32 and two side plates, which are not shown. The plates 31, 32 of the inlet lock 9 are connected steam-tight with one another and with the front wall 26. The inlet lock 9 is subdivided into an upper main chamber 36 and a lower pre-chamber 37 by intermediate plates 33, 34 that extend from the front plate 31 and from the front wall 26 into the interior of the inlet lock 9 and leave a gap 35 for passage of the product web 1. The pre-chamber 37 is open downwardly. A suction device is connected with the pre-chamber 37 and in this example by a suction passage 38, which is connected with a not-shown fan. In some cases, as in this example, a suction box 39 to which the suction passage 38 is connected is located in the pre-chamber 37. The first guiding roller 16 of the transporting device is located below the pre-chamber 37 and the second or the last guiding roller 17 is located before the inlet slot 27. The outlet lock 11 is formed analogously to the inlet lock 9. The first and second guiding rollers 18, 19 are arranged analogously to the inlet lock 9 and the third guiding roller 20 is arranged behind the outlet slot 11.

For dyeing the product web 1 is taken from the product storage device 2 via the supply device 3 formed as a boom, and supplied through the dye device 4 formed as a padder and the air passage 5 to the device 6 for dye fixing.

The product web 1 is transported over the guiding roller 16 of the transporting device from below into the pre-chamber 37 of the inlet lock 9, through the pre-chamber 37 and through the gap 35 in the main chamber 36 and through the inlet slot 27 in the first treatment chamber 12 of the device 6. The transportation of the product web 1 through the treatment chambers 12, 13 is performed by the roller conveyor arranged between the first and second chambers 12 and 13 in a horizontal plane and under a longitudinal tension of 10–100 N/m.

In the roller conveyor the product web 1 is guided meanderingly, one after the other and over the guiding roller 21, the driven pulling roller 23 and the guiding roller 22. The desired longitudinal tension is adjusted by height adjustment of the pulling roller 23. In some cases occurring displacements of the product web 1 are compensated by the adjustment of the pulling roller 23, and in particular by an angular adjustment of the axis of the pulling roller 23 parallel to the transporting plane.

The product web 1 leaves the device 6 through the outlet slot 29 and the outlet lock 11. It is supplied via the supply device 7 formed as a boom to the product storage device 8 formed as a winding roller. The product web speed amounts to, for example, 40 m/min. In the dye device 4 the dye solution is applied on the product web 1. In the air passage 5 a blending of the dye solution on the product web 1 is performed.

The moist product web 1 during its transportation on the roller conveyor flatly through the treatment chambers 12, 13 of the device 6 is subjected to the action of hot steam from the nozzle boxes 15 arranged above and below the product web 1 with the nozzle openings oriented toward the product web 1. The nozzle pressure amounts to 200–1000 PA and the heat transfer power to substantially 240 $W/m^2$.

The temperature of the hot steam amounts to 160–230° C. and the retention time of the product web 1 in the treatment chambers 12, 13 amounts to 5–60 seconds, preferably 10–30 seconds. The residual moisture of the product web 1 on leaving the housing 10 is approximately equal to or less than the equilibrium moisture content under normal conditions or, in other words, less than or substantially equal to 10%. In the treatment chambers 12, 13 and in the main chambers 36, the inlet and outlet locks 9, 11 are maintained at a slight overpressure. The steam content, preferably between 95–100 vol. percent, is maintained by changing the quantity of the aspirated treatment gas through the suction passages 38 of the pre-chambers 37 of the inlet and outlet locks 9, 11. Regulation of the residual moisture content of the product web is not needed.

It will be understood that each of the elements described above, or two or more together, may also find a useful application in other types of methods and constructions differing from the types described above.

While the invention has been illustrated and described as embodied in method of and an arrangement for continuous thermal treatment of a textile product web, in particular for dye fixing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for dyeing a textile product web, said apparatus comprising means for applying a dye solution to the textile product web to form a moist product web with the dye solution applied thereto;

a steam-tight housing comprising at least one treatment chamber for performing a heat treatment of said moist product web with hot steam;

means far transporting the moist product web through the steam-tight housing during the heat treatment in a substantially horizontal orientation;

nozzle boxes arranged within the steam-tight housing and above and below the product web when the product web is transported through the steam-tight housing during the heat treatment; and circulating means for circulating the hot steam within the steam-tight housing;

wherein said means for transporting comprises a roller conveyor and said nozzle boxes each comprise means for directing said hot steam toward said product web so that said hot steam contacts said product web;

whereby dye fixing and drying of said moist product web take place simultaneously during the heat treatment with said hot steam, so that the moist product web has a residual moisture content smaller than or equal to an equilibrium moisture content under normal conditions.

2. The apparatus as defined in claim 1, wherein said steam-tight housing comprises two treatment chambers and said roller conveyor is located in a region between said two treatment chambers.

3. The apparatus as defined in claim 2, wherein said roller conveyor comprises two guiding rollers and a pulling roller, said guiding rollers are mounted next to each other and said pulling roller is arranged under said guiding rollers and centered in relation to said guiding rollers.

4. The apparatus as defined in claim 3, wherein said pulling roller is an orienting roller.

5. The apparatus as defined in claim 1, further comprising an inlet lock for the steam-tight housing arranged downstream of the steam-tight housing with respect to transport of the product web and an outlet lock for the steam-tight housing arranged upsteam of the steam-tight housing, and wherein said inlet lock and said outlet lock extend above and below a transport plane of the product web through the steam-tight housing and toward a bottom of said steam-tight housing.

6. The apparatus as defined in claim 5, wherein said inlet lock comprises an upper main chamber end a lower pre-chamber and said lower pre-chamber is equipped with or connected to a suction device for providing suction, whereby penetration of air end thus condenaation of steam to water is reliably prevented.

* * * * *